US010369802B2

(12) United States Patent
McAuliffe

(10) Patent No.: US 10,369,802 B2
(45) Date of Patent: Aug. 6, 2019

(54) INK FILTER WITH PASSIVE DE-AERATION

(71) Applicant: Memjet Technology Limited, Dublin (IE)

(72) Inventor: Patrick McAuliffe, North Ryde (AU)

(73) Assignee: Memjet Technology Limited (IE)

( * ) Notice: Subject to any disclaimer, the term of this patent is extended or adjusted under 35 U.S.C. 154(b) by 0 days.

(21) Appl. No.: 16/022,449

(22) Filed: Jun. 28, 2018

(65) Prior Publication Data

US 2019/0009559 A1 Jan. 10, 2019

Related U.S. Application Data

(60) Provisional application No. 62/530,764, filed on Jul. 10, 2017.

(51) Int. Cl.

| | |
|---|---|
| ***B41J 2/175*** | (2006.01) |
| ***B41J 2/19*** | (2006.01) |
| ***B41J 2/18*** | (2006.01) |
| ***B41J 2/195*** | (2006.01) |

(52) U.S. Cl.

CPC ..... *B41J 2/17563* (2013.01); *B41J 2/175* (2013.01); *B41J 2/17596* (2013.01); *B41J 2/18* (2013.01); *B41J 2/19* (2013.01); *B41J 2/195* (2013.01)

(58) Field of Classification Search

CPC .... B41J 2/175; B41J 2/17563; B41J 2/17596; B41J 2/18; B41J 2/19

See application file for complete search history.

(56) References Cited

U.S. PATENT DOCUMENTS

| | | | | |
|---|---|---|---|---|
| 6,481,837 | B1 * | 11/2002 | Askren | B41J 2/175 347/85 |
| 6,691,733 | B1 * | 2/2004 | Morris | F16L 41/16 137/317 |
| 7,014,303 | B2 * | 3/2006 | Matsushita | B41J 2/19 347/85 |
| 8,926,072 | B2 * | 1/2015 | Balala | B41J 2/175 347/85 |
| 2004/0232076 | A1 * | 11/2004 | Zha | B01D 61/18 210/636 |
| 2010/0053286 | A1 * | 3/2010 | Ito | B41J 2/17509 347/93 |

* cited by examiner

*Primary Examiner* — Anh T Vo
(74) *Attorney, Agent, or Firm* — Cooley LLP

(57) ABSTRACT

An ink filter for an ink delivery system. The ink filter includes: a filter chamber having a filter inlet port, a filter outlet port and a vent port, the vent port being positioned in a roof of the filter chamber; a filter material positioned between the filter inlet port and the filter outlet port; and a closed vent chamber connected to the vent port. The vent chamber has wall exposed to atmosphere formed of an air-permeable polymer.

20 Claims, 2 Drawing Sheets

INK FILTER WITH PASSIVE DE-AERATION

CROSS REFERENCE TO RELATED APPLICATIONS

The present application claims the benefit of priority under 35 U.S.C. § 119(e) of U.S. Provisional Application Ser. No. 62/530,764, entitled INK FILTER WITH PASSIVE DE-AERATION, filed Jul. 10, 2018, the content of which is hereby incorporated by reference in its entirety for all purposes.

FIELD OF THE INVENTION

This invention relates to an ink filter for use in an ink delivery system of an inkjet printer. It has been developed primarily for recovering ink filters blocked with air bubbles.

BACKGROUND OF THE INVENTION

Inkjet printers employing Memjet® technology are commercially available for a number of different printing formats, including small-office-home-office ("SOHO") printers, label printers, digital inkjet presses and wideformat printers. Memjet® printers typically comprise one or more stationary inkjet printheads, which are user-replaceable. For example, a desktop printer may comprise a single user-replaceable multi-colored or monochrome printhead, a high-speed digital press may comprise a plurality of user-replaceable monochrome printheads aligned along a media feed direction, and a wideformat printer may comprise a plurality of user-replaceable printheads in a staggered overlapping arrangement so as to span across a wideformat pagewidth.

Ink is supplied to an inkjet printhead via an ink delivery system, which is designed primarily for delivering ink to the printhead at a predetermined hydrostatic pressure. Ink delivery systems also typically include an ink filter for filtering particulates from the ink. The ink filter may comprise any suitable filter material housed in a chamber having an inlet and an outlet.

Air bubbles are a perennial problem in inkjet printers. Air bubbles that reach inkjet nozzles can block nozzles and cause catastrophic deprime events. Air bubbles can also reduce the efficacy of ink filters in the ink delivery system by blocking microscopic pores in the filter material.

To some extent, the problems associated with air bubbles can be mitigated through the use of degassed ink in a closed ink delivery system. However, such ink delivery systems are not immune to the problems of air bubbles even when degassed ink is employed. For example, air may be intentionally introduced into the ink delivery system via printhead depriming operations when air is drawn through the printhead so that the printhead can be replaced. This introduced air can circulate around the ink delivery system and become trapped in the ink filter, thereby reducing the efficacy of the ink filter and adversely affecting print quality. If the ink filter becomes catastrophically blocked with air bubbles, it will require replacement by the user which is both inconvenient and time-consuming.

In some ink delivery systems described in the prior art, the ink filter is connected to a de-aeration pump, which removes air from the filter chamber housing the filter material. The de-aeration pump ensures that any air bubbles trapped in the ink filter can escape to atmosphere without causing long-term problems through continuous build-up of air bubbles. However, de-aeration pumps add to the cost and complexity of ink delivery systems.

It would therefore be desirable to provide an ink filter, which enables removal of air bubbles without relying on a de-aeration pump.

SUMMARY OF THE INVENTION

In a first aspect, there is provided an ink filter for an ink delivery system, the ink filter comprising:

- a filter chamber having a filter inlet port, a filter outlet port and a vent port, the vent port being positioned in a roof of the filter chamber;
- a filter material positioned between the filter inlet port and the filter outlet port; and
- a closed vent chamber connected to the vent port, wherein the vent chamber has at least one wall exposed to atmosphere comprised of an air-permeable polymer.

The ink filter according to the first aspect advantageously enables passive recovery of the ink filter in the event that any air enters the filter chamber.

Preferably, the vent chamber is comprised of air-permeable polymer tubing having one end connected to the vent port and an opposite end capped.

Preferably, the polymer tubing extends generally upwards from the vent port and defines sidewalls of the vent chamber.

Preferably, the vent port is positioned for removing air bubbles from unfiltered ink in the filter chamber.

Preferably, the air-permeable polymer has an oxygen permeability in the range of 5 to 50 Barrer (16.74 to $167.4\times10^{-19}$ kmol m/(m$^2$ s Pa)).

In one embodiment, the vent chamber is connected to the vent port via a diffusion tube. The diffusion tube typically has sidewalls impermeable to air and a length in the range of 1 to 10 cm.

Preferably, the vent chamber contains ink at a positive hydrostatic pressure for a majority of time over the lifetime of a printer incorporating the ink filter.

Preferably, the vent chamber contains ink at a positive hydrostatic pressure during idle periods of the printer incorporating the ink filter.

In a second aspect, there is provided an inkjet printer comprising:

- an ink tank containing ink having a predetermined ink level;
- an ink filter positioned below the predetermined ink level; and
- an inkjet printhead positioned above the predetermined ink level, wherein the ink filter comprises:

- a filter chamber having a filter inlet port for receiving ink from the ink tank, a filter outlet port for delivering ink to the printhead and a vent port, the vent port being positioned in a roof of the filter chamber;
- a filter material positioned between the filter inlet port and the filter outlet port; and
- a closed vent chamber connected to the vent port, and wherein the vent chamber has at least one wall exposed to atmosphere comprised of an air-permeable polymer.

Preferably, the air-permeable polymer has sufficient permeability to allow recovery of the ink filter within 20 days at a predetermined positive hydrostatic pressure, more preferably within 10 days.

Preferably, at least part of the vent chamber is positioned above the predetermined ink level.

Preferably, at least part of the vent chamber is positioned below the predetermined ink level.

Preferred embodiments described in connection with the first aspect are, of course, equally applicable to the second aspect.

As used herein, the term "ink" is taken to mean any printing fluid, which may be printed from an inkjet printhead. The ink may or may not contain a colorant. Accordingly, the term "ink" may include conventional dye-based or pigment based inks, infrared inks, fixatives (e.g. pre-coats and finishers), 3D printing fluids and the like.

As used herein, the term "printer" refers to any printing device for marking print media, such as conventional desktop printers, label printers, duplicators, copiers, digital inkjet presses and the like. In one embodiment, the printer is a sheet-fed printing device.

BRIEF DESCRIPTION OF THE DRAWINGS

Embodiments of the present invention will now be described by way of example only with reference to the accompanying drawing, in which.

DETAILED DESCRIPTION OF THE INVENTION

Gravity-Feed Ink Delivery System

A gravity-feed ink delivery system is described hereinbelow as one exemplary use of the ink filter according to the first aspect. However, it will be appreciated that the ink filter according to the first aspect is equally suitable for use in any ink delivery system where the ink filter has ink contained therein at a positive hydrostatic pressure for a majority of time.

Figure 1:
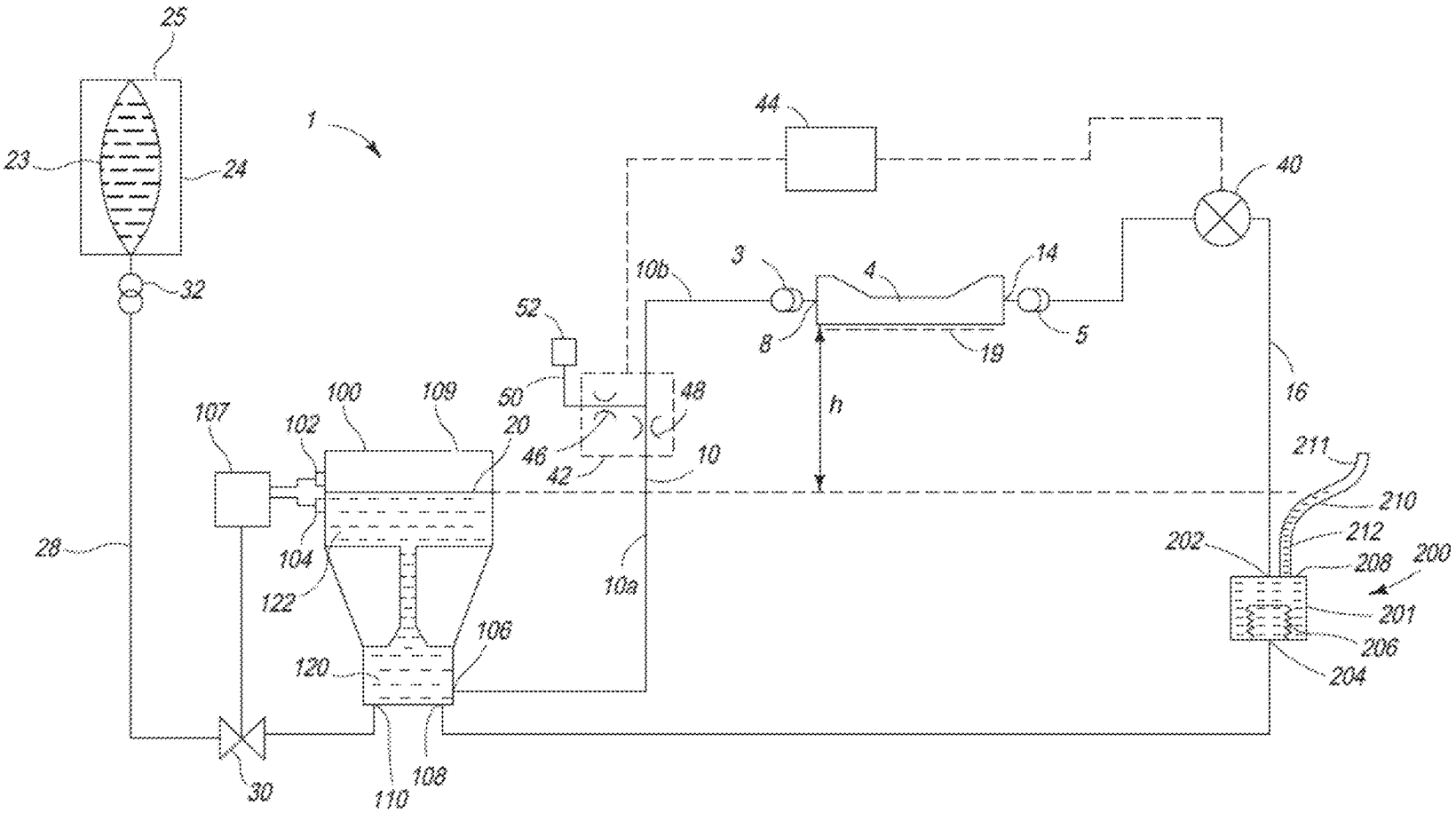
FIG. 1 shows schematically a printer ink delivery system incorporating an ink filter according to the first aspect.

Referring to FIG. 1, there is shown schematically a printer 1 having an ink delivery system for supplying ink to a printhead 4. The ink delivery system is a gravity-feed system, which is similar in function to those described in US2011/0279566 and US2011/0279562, the contents of which are herein incorporated by reference.

The ink delivery system comprises an intermediary ink tank 100 having an ink outlet port 106 connected to a printhead inlet port 8 of a printhead 4 via a first ink line 10. An ink return port 108 of the intermediary ink tank 100 is connected to a printhead outlet port 14 of the printhead 4 via a second ink line 16, which incorporates an ink filter 200. Hence, the intermediary ink tank 100, the first ink line 10, the printhead 4 and the second ink line 16 incorporating the ink filter 200 define a closed fluidic loop. Typically, the first ink line 10 and second ink line 16 are comprised of lengths of flexible tubing.

The printhead 4 is user-replaceable by means of a first coupling 3 releasably interconnecting the printhead inlet port 8 and the first ink line 10; and a second coupling 5 releasably interconnecting the printhead outlet port 14 and the second ink line 16. The printhead 4 is typically a pagewide printhead and may be, for example, a printhead as described in US2011/0279566 or U.S. Application No. 62/330,776 filed 2 May 2016 entitled "Monochrome Inkjet Printhead Configured for High-Speed Printing", the contents of which are incorporated herein by reference.

The intermediary ink tank 100 is open to atmosphere via a gas port in the form of an air vent 109 positioned in an upper portion of the tank. Accordingly, during normal printing, ink is supplied to the printhead 4 at a negative hydrostatic pressure ("backpressure") under gravity. In other words, gravity-feeding of ink from the intermediary ink tank 100, which is positioned below the printhead 4, provides a pressure-regulating system for suppling ink to the printhead at a predetermined negative hydrostatic pressure. The amount of backpressure experienced at the nozzle plate 19 of the printhead 4 is determined by the height h of the nozzle plate above a level of ink 20 in the intermediary ink tank 100.

In the embodiment shown, the intermediary tank 100 comprises a lower chamber 120 having an ink inlet port 110, the ink outlet port 106 and the return port 108. The lower chamber 120 is connected to an upper chamber 122 via a tank diffusion tube 124, which protects the lower chamber from aerated ink in the upper chamber whilst still enabling gravity control of pressure. The intermediary tank 100 incorporating the tank diffusion tube 124 is described in more detail in co-pending U.S. Provisional Application No. 62/463,330 filed on Feb. 24, 2017 entitled "Ink tank for regulating ink pressure", the contents of which are herein incorporated by reference Ink is supplied to the ink inlet port 110 of the intermediary ink tank 100 from a bulk ink reservoir comprising a collapsible ink bag 23 housed by an ink cartridge 24. The ink cartridge 24 is open to atmosphere via a cartridge vent 25 so that the collapsible ink bag 23 can collapse as ink is consumed by the system. The collapsible ink bag 23 is typically an air-impermeable foil bag containing degassed ink, which is supplied to the ink inlet port 110 via an ink supply line 28. The ink cartridge 24 is typically user-replaceable and connected to the ink supply line 28 via a suitable ink supply coupling 32. The ink supply line 28 may comprise an inline ink filter (not shown) for filtering ink before it reaches the intermediary tank 100.

A control system is used to maintain a substantially constant level of ink in the intermediary ink tank 100 and, therefore, a constant height h and corresponding backpressure. As shown in FIG. 1, a control valve 30 is positioned in the ink supply line 28 and controls a flow of ink from the cartridge 24 into the intermediary ink tank 100. The control valve 30 is operated under the control of a first controller 107, which receives feedback from 'high' and 'low' sensors 102 and 104 (e.g. optical sensors) positioned at a sidewall of the upper chamber 122 of intermediary ink tank 100. When the level of ink 20 falls below the 'low' sensor 104, the first controller 107 signals the valve 30 to be opened, and when the level of ink reaches the 'high' sensor 102, the controller signals the valve to close. In this way, the level of ink 20 in the intermediary ink tank 100 may be maintained relatively constant.

The closed fluidic loop, incorporating the intermediary ink tank 100, the first ink line 10, the printhead 4 and the second ink line 16, facilitates priming, de-priming and other required fluidic operations. The second ink line 16 includes a reversible peristaltic pump 40 for circulating ink around the fluidic loop. By way of convention only, the "forward" direction of the first pump 40 corresponds to pumping ink from the ink outlet port 106 to the return port 108 (i.e. clockwise as shown in FIG. 1), and the "reverse" direction of the pump corresponds to pumping ink from the return port 108 to the ink outlet port 106 (i.e. anticlockwise as shown in FIG. 1).

The pump 40 cooperates with a pinch valve arrangement 42 to coordinate various fluidic operations. The pinch valve arrangement 42 comprises a first pinch valve 46 and a second pinch valve 48, and may take the form of any of the pinch valve arrangements described in, for example, US 2011/0279566; US 2011/0279562; and U.S. Pat. No. 9,180,676, the contents of which are incorporated herein by reference.

The first pinch valve 46 controls a flow of air through an air conduit 50, which is branched from the first ink line 10. The air conduit 50 terminates at an air filter 52, which is open to atmosphere and functions as an air intake for the closed fluidic loop.

By virtue of the air conduit 50, the first ink line 10 is divided into a first section 10*a* between the ink outlet port 106 and the air conduit 50, and a second section 10*b* between the printhead inlet port 8 and the air conduit 50. The second pinch valve 48 controls a flow of ink through the first section 10*a* of the first ink line 10.

The pump 40, the first pinch valve 46 and the second pinch valve 48 are controlled by a second controller 44, which coordinates various fluidic operations. From the foregoing, it will be appreciated that the ink delivery system shown in FIG. 1 provides a versatile range of fluidic operations. Table 1 describes various pinch valve and pump states for some example fluidic operations used in the printer 1. Of course, various combinations of these example fluidic operations may be employed.

TABLE 1

Example Fluidic Operations for Printer 1

| Fluidic Operation | Second Pinch Valve 48 | First Pinch Valve 46 | First Pump 40 |
|---|---|---|---|
| PRINT | open | closed | off |
| PRIME | open | closed | forward |
| STANDBY | open | closed | off |
| PULSE | closed | closed | reverse |
| DEPRIME | closed | open | forward |
| NULL | closed | closed | off |

During normal printing ("PRINT" mode), the printhead 4 draws ink from intermediary ink tank 100 at a negative backpressure under gravity. In this mode, the peristaltic pump 40 functions as a shut-off valve, whilst the first pinch valve 46 is closed and the second pinch valve 48 is open to allow ink flow from the ink outlet port 106 to the first port 8 of the printhead 4. During printing, ink is supplied to the ink inlet port 110 of the intermediary ink tank 100, under the control of the first controller 107, to maintain a relatively constant ink level 20 and, consequently, a relatively constant backpressure for the printhead 4.

During printhead priming or flushing ("PRIME" mode), ink is circulated around the closed fluidic loop in the forward direction (i.e. clockwise as shown in FIG. 1) with the control valve 30 closed. In this mode, the peristaltic pump 40 is actuated in the forward pumping direction whilst the first pinch valve 46 is closed and the second pinch valve 48 is open to allow ink flow from the ink outlet port 106 to the ink return port 108 via the printhead 4. Priming in this manner may be used to prime a deprimed printhead with ink, flush air bubbles from the printhead 4 and/or filter particulates from the ink.

In the "STANDBY" mode, the pump 40 is switched off whilst the first pinch valve 46 is closed and the second pinch valve 48 is open. The "STANDBY" mode maintains a positive hydrostatic ink pressure in the ink filter 200 positioned below the ink level 20 in the intermediary tank 100, and a negative hydrostatic ink pressure at the printhead 4 positioned above the ink level. The negative ink pressure at the printhead 4 prevents ink from flooding the nozzle plate 19, as well as minimizing color mixing when the printer is idle; while the positive ink pressure in the ink filter 200 assists with air bubble removal as will be explained in more detail below. Usually, the printhead is capped in the standby mode to minimize evaporation of ink from the nozzles (see, for example, US2011/0279519, the contents of which are herein incorporated by reference).

In order to ensure each nozzle of printhead 4 is fully primed with ink and/or to unblock any nozzles which have become clogged, a "PULSE" mode may be employed. In the "PULSE" mode, the first and second pinch valves 46 and 48 are closed, while the pump 40 is actuated in a reverse direction (i.e. anticlockwise as shown in FIG. 1) to force ink through nozzles in the nozzle plate 19 of the printhead 4. The control valve 30 is closed during pulse priming and the intermediary ink tank 100 provides a reservoir of ink required for pulse priming.

In order to replace a spent printhead 4, it is necessary to de-prime the printhead before it can be removed from the printer. In the "DEPRIME" mode, the first pinch valve 46 is open, the second pinch valve 48 is closed and the first pump 40 is actuated in the forward direction to draw in air from atmosphere via the air conduit 50. Once the printhead 4 has been deprimed of ink, the printer is set to "NULL" mode, which isolates the printhead from the ink supply, thereby allowing safe removal of the printhead with minimal ink spillages.

Ink Filter

From the foregoing, it will be appreciated that a number of fluidic operations may be performed using the ink delivery system described above in connection with FIG. 1. However, it will further be appreciated that, in an ink delivery system employing degassed ink, it is undesirable to introduce air into the system during printhead depriming. Dissolved air may be circulated around the ink delivery system and removed by printing. However, non-dissolved air bubbles behave similarly to particulates and are typically trapped by the ink filter 200.

Figure 2:
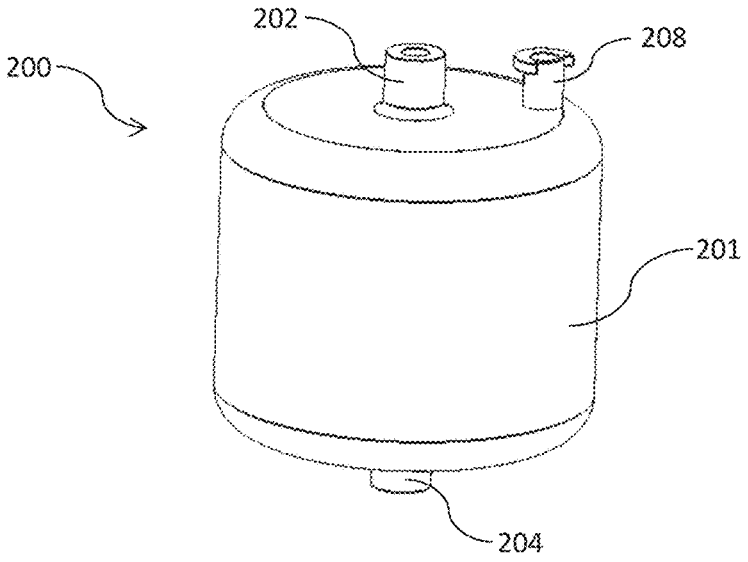
FIG. 2 is a perspective view of an ink filter according to the first aspect.
Figure 3:
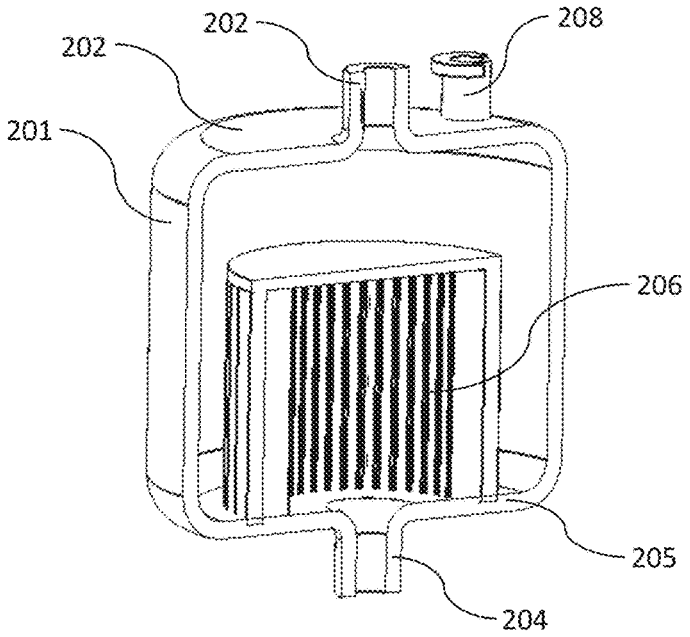
FIG. 3 is a sectional view of the filter shown in FIG. 3.

Referring to FIGS. 1 to 3, the inline ink filter 200 comprises a filter chamber 201 having a filter inlet port 202 in a roof 203 thereof, a filter outlet port 204 in a base 205 thereof, and a filter material 206 positioned between the filter inlet and outlet ports. The filter material 206 is typically configured as a cylinder having concertinaed sidewalls positioned around the filter outlet port 204 to maximize filtration surface, although it will be appreciated that any suitable configuration of filter material may be employed. The ink filter 200 functions primarily to filter particulates from the ink before they reach the printhead 4, but also serves to filter any non-dissolved air bubbles from the ink after, for example, a depriming operation. Non-dissolved air bubbles behave similarly to particulates and are readily trapped by the filter material 206. On the other hand, ink containing dissolved air passes through the filter material 206 and can be expelled from the ink delivery system via printing. Fresh degassed ink entering the ink delivery system from the ink cartridge 24 via the intermediary tank 100 eventually displaces all the residual aerated ink in the system.

The ink filter 200 is preferably a non-replaceable (or at least an infrequently replaceable) component of the ink delivery system and non-dissolved air bubbles, which do not pass through the filter material 206, are potentially problematic in terms of limiting the lifetime of the ink filter. These air bubbles become trapped in unfiltered ink upstream of the filter material 206 and may reduce the efficacy of the ink filter 200 by blocking pores in the filter material. If the ink filter 200 becomes blocked with too many air bubbles, it will need to be replaced or serviced.

As foreshadowed above, de-aeration pumps have been employed in some prior art ink delivery systems to remove air from ink filters; however, de-aeration pumps add to the cost and complexity of ink delivery systems. In the ink filter 200 shown in FIG. 1, a vent port 208 defined in the roof 203 of the filter chamber 201 is connected to a closed vent chamber in the form a length of air-permeable tubing 210, which extends upwards from the roof 203. The air-permeable tubing 210 is capped at one end 211 and has air-permeable walls with sufficient permeability to allow air to diffuse outwards through the walls at a predetermined positive ink pressure. Accordingly, during idle periods air bubbles may diffuse out of the air-permeable tubing, thereby passively maintaining the ink filter without requiring a dedicated de-aeration pump. In order to operate effectively, at least part of the air-permeable tubing 210 should be positioned below the ink level 20 of the intermediary ink tank 100 so that ink in the air-permeable tubing 210 is at a positive ink pressure for a majority of the time (e.g. during idle periods) allowing diffusion of air to atmosphere.

For effective air removal, the air-permeable tubing 210 typically has an oxygen-permeability of less than 100 Barrer (334.8×10-19 kmol m/($m^2$ s Pa)), or preferably in the range of 5 to 50 Barrer (16.74 to 167.4×10-19 kmol m/($m^2$ s Pa)). The polymer tubing may have a wall thickness in the range of 1 to 2 mm, and an internal diameter in the range of 2 to 5 mm. One type of suitable air-permeable tubing is Tygoprene® XL-60, which is a thermoplastic elastomer available from Saint-Gobain Performance Plastics. However, it will be appreciated that other air-permeable materials are equally suitable.

The air-permeable tubing 210 may either be connected directly to the vent port 208 or, as shown in FIG. 1, it may be connected to the vent port 208 via a vent diffusion tube 212. The vent diffusion tube 212 protects the ink delivery system from aerated ink in the air-permeable tubing 210, which may enter the system adventitiously via diffusion. Hence, air bubbles in the ink filter 200 are allowed to float upwards into the air-permeable tubing where they are removed by diffusion through the walls of the tubing; however, the aerated ink in the air-permeable tubing 210 cannot re-enter the ink delivery system via a Fickian diffusion mechanism (at least not on a reasonable timescale) by virtue of the vent diffusion tube 212. The vent diffusion tube 212 functions in a similar manner to the tank diffusion tube 124 and therefore has similar requirements. The vent diffusion tube 212 is typically formed from rigid air-impermeable plastics and typically has a length in the range of 1 to 10 cm. For example, a vent diffusion tube 210 having a length of 4 cm corresponds to a diffusion timescale of more than 20 days for most inks. The vent diffusion tube 212 may have a bubble-tolerant internal cross-section (e.g. star-shaped) to avoid blockages caused by air bubbles.

Although the ink filter 200 has been described as an inline filter in the second ink line 16, it will be appreciated that it may be used in any suitable ink line. For example, there may be an inline ink filter positioned in the ink supply line 28, which is susceptible to ingress of air during replacement of ink cartridges, or the first ink line 10. Provided that the ink delivery system is configured to provide a positive ink pressure to the ink filter 200 for a majority of time, then the ink filter functions as a passively-recovering air filter by removal of air bubbles from the filter chamber 201 via the air-permeable tubing 210.

It will, of course, be appreciated that the present invention has been described by way of example only and that modifications of detail may be made within the scope of the invention, which is defined in the accompanying claims.

The invention claimed is:

1. An ink filter for an ink delivery system comprising:

a filter chamber having a filter inlet port, a filter outlet port and a vent port, the vent port being positioned in a roof of the filter chamber;

a filter material positioned between the filter inlet port and the filter outlet port; and a closed vent chamber connected to the vent port, wherein the vent chamber has at least one wall exposed to atmosphere comprised of an air-permeable polymer.

2. The ink filter of claim 1, wherein the vent chamber is comprised of air-permeable polymer tubing having one end connected to the vent port and an opposite end capped.

3. The ink filter of claim 1, wherein the polymer tubing extends generally upwards from the vent port and defines sidewalls of the vent chamber.

4. The ink filter of claim 1, wherein the vent port is positioned for removing air bubbles from unfiltered ink in the filter chamber.

5. The ink filter of claim 1, wherein the air-permeable polymer has an oxygen permeability in the range of 5 to 50 Barrer (16.74 to $167.4\times10^{-19}$ kmol m/($m^2$ s Pa)).

6. The ink filter of claim 1, wherein the vent chamber is connected to the vent port via a diffusion tube.

7. The ink filter of claim 6, wherein the diffusion tube has sidewalls impermeable to air.

8. The ink filter of claim 6, wherein the diffusion tube has a length in the range of 1 to 10 cm.

9. The ink filter of claim 1, wherein vent chamber contains ink at a positive hydrostatic pressure for a majority of time over the lifetime of a printer incorporating the ink filter.

10. The ink filter of claim 9, wherein the vent chamber contains ink at a positive hydrostatic pressure during idle periods of the printer incorporating the ink filter.

11. An inkjet printer comprising:

an ink tank containing ink having a predetermined ink level;

an ink filter positioned below the predetermined ink level; and an inkjet printhead positioned above the predetermined ink level, wherein the ink filter comprises:

a filter chamber having a filter inlet port for receiving ink from the ink tank, a filter outlet port for delivering ink to the printhead and a vent port, the vent port being positioned in a roof of the filter chamber;

a filter material positioned between the filter inlet port and the filter outlet port; and a closed vent chamber connected to the vent port, and wherein the vent chamber has at least one wall exposed to atmosphere comprised of an air-permeable polymer.

12. The printer of claim 11, wherein the vent chamber is comprised of air-permeable polymer tubing having one end connected to the vent port and an opposite end capped.

13. The printer of claim 11, wherein the polymer tubing extends generally upwards from the vent port and defines sidewalls of the vent chamber.

14. The printer of claim 11, wherein the vent port is positioned for removing air bubbles from unfiltered ink in the filter chamber.

15. The printer of claim 11, wherein the air-permeable polymer has an oxygen permeability in the range of 5 to 50 Barrer (16.74 to $167.4\times10^{-19}$ kmol m/($m^2$ s Pa)).

16. The printer of claim 11, wherein the vent chamber is connected to the vent port via a diffusion tube.

17. The printer of claim 11, wherein the vent chamber contains ink at a positive hydrostatic pressure during idle periods of the printer.

18. The printer of claim 17, wherein the air-permeable polymer has sufficient permeability to allow recovery of the ink filter within 20 days at a predetermined positive hydrostatic pressure.

19. The printer of claim 11, wherein at least part of the vent chamber is positioned above the predetermined ink level.

20. The printer of claim 11, wherein at least part of the vent chamber is positioned below the predetermined ink level.

* * * * *